US012791026B2

(12) United States Patent
Sakai et al.

(10) Patent No.: US 12,791,026 B2
(45) Date of Patent: Nov. 10, 2026

(54) GAS COMPRESSOR

(71) Applicant: Hitachi Industrial Equipment Systems Co., Ltd., Tokyo (JP)

(72) Inventors: Kouhei Sakai, Tokyo (JP); Takehiro Matsuzaka, Tokyo (JP); Masahiko Takano, Tokyo (JP); Toshiaki Yabe, Tokyo (JP); Sho Nikaido, Tokyo (JP); Shotaro Sano, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 19/162,492

(22) PCT Filed: Nov. 8, 2023

(86) PCT No.: PCT/JP2023/040141
§ 371 (c)(1),
(2) Date: Sep. 5, 2025

(87) PCT Pub. No.: WO2024/247306
PCT Pub. Date: Dec. 5, 2024

(65) Prior Publication Data

US 2026/0243261 A1 Aug. 20, 2026

(30) Foreign Application Priority Data

May 26, 2023 (JP) ..... 2023-087252

(51) Int. Cl.
*F04C 29/04* (2006.01)
*F04B 49/06* (2006.01)
(Continued)

(52) U.S. Cl.
CPC ..... *F04C 29/04* (2013.01); *F04B 49/06* (2013.01); *F04C 28/26* (2013.01); *F04D 27/009* (2013.01);
(Continued)

(58) Field of Classification Search
CPC ..... F04D 27/005; F04B 39/06; F04C 28/26; F04C 29/04
See application file for complete search history.

(56) References Cited

U.S. PATENT DOCUMENTS

2015/0362212 A1 12/2015 Yamamoto et al.
2022/0163027 A1* 5/2022 Matsuzaka ..... F04C 28/26

FOREIGN PATENT DOCUMENTS

JP 2016-79894 A 5/2016
JP 2018-13319 A 1/2018
(Continued)

OTHER PUBLICATIONS

International Search Report (PCT/ISA/210) issued in PCT Application No. PCT/JP2023/040141 dated Jan. 23, 2024 with English translation (5 pages).
(Continued)

*Primary Examiner* — Kenneth J Hansen
(74) *Attorney, Agent, or Firm* — Crowell & Moring LLP

(57) ABSTRACT

A technique for reducing pressure losses caused by cooling of compressed gas is provided. A gas compressor 100 includes a bypass path 11 that bypasses an aftercooler 10, a bypass valve 13 in the bypass path 11, and a cooler bypass valve 12 between a connection portion 19*b* and the aftercooler 10. An ammeter 16 detects a current value of motor 1 and a temperature sensor 14 detects a temperature of compressed gas after waste heat has been recovered by a high-pressure stage waste heat recovery heat exchanger 9. Ambient temperature sensor 22 detects ambient temperature around the gas compressor 100. A control device 17 opens and closes the bypass valve 13 and the cooler bypass valve 12 based on the current value detected by the ammeter 16, the temperature detected by the temperature sensor 14 and the temperature detected by the temperature sensor 22.

4 Claims, 3 Drawing Sheets

(51) Int. Cl.
*F04C 28/26* (2006.01)
*F04D 27/00* (2006.01)

(52) U.S. Cl.
CPC ..... *F04C 2270/07* (2013.01); *F04C 2270/19* (2013.01)

(56) References Cited

FOREIGN PATENT DOCUMENTS

| | | | |
|---|---|---|---|
| JP | 2019-15500 | A | 1/2019 |
| WO | WO 2014/115616 | A1 | 7/2014 |

OTHER PUBLICATIONS

Japanese-language Written Opinion (PCT/ISA/237) issued in PCT Application No. PCT/JP2023/040141 dated Jan. 23, 2024 with English translation (5 pages).

* cited by examiner

GAS COMPRESSOR

TECHNICAL FIELD

The present invention relates to a gas compressor.

BACKGROUND ART

In a gas compressor provided with a cooling heat exchanger for cooling the gas compressed by the compressor body, it is known to recover heat from the compressed gas by passing the compressed gas through a waste heat recovery heat exchanger disposed upstream of the cooling heat exchanger. The waste heat recovery heat exchanger recovers compression heat from the compressed gas by exchanging heat between the compressed gas and circulating water, thereby heating the circulating water.

In a gas compressor of the load/unload type equipped with a waste heat recovery heat exchanger, waste heat recovery becomes unnecessary when the operation shifts from load to unload. Patent Document 1 discloses a compressor in which a shut-off valve is provided in the piping connected to the waste heat recovery heat exchanger, a bypass valve is provided in a path bypassing the waste heat recovery heat exchanger, and a water supply valve is provided in the water supply line of the waste heat recovery heat exchanger. In this compressor, when placing the waste heat recovery heat exchanger in a water-passing state, the valves are operated in the order of opening the water supply valve, opening the shut-off valve, and closing the bypass valve. Conversely, when placing the waste heat recovery heat exchanger in a water-stopped state, the valves are operated in the order of opening the bypass valve, closing the shut-off valve, and closing the water supply valve.

CITATION LIST

Patent Document

[Patent Document 1] Patent Publication No. 2019-15500 A

SUMMARY OF THE INVENTION

Problems to be Solved by the Invention

In the technology described in Patent Document 1, it is possible to switch the flow of compressed gas from the compressor either through the waste heat recovery heat exchanger or through a bypass path. However, when the compressed gas passes through both the waste heat recovery heat exchanger and the cooling heat exchanger, the pressure loss of the compressed gas increases compared to the case where the waste heat recovery heat exchanger is bypassed.

Generally, a gas compressor is configured to detect the pressure of the compressed gas at the package outlet and control the power of the compressor body so that the pressure reaches a predetermined level. Therefore, if a pressure loss occurs and the pressure of the compressed gas decreases, it becomes necessary to increase the pressure to compensate for the loss, resulting in an increase in the power required by the compressor body.

Here, one adverse effect of an increase in the power of the compressor body is that, for example, if the maximum current value of components such as the motor is exceeded, the temperature of the components may rise, potentially leading to component failure. In addition, as the compressor body increases the pressure, the temperature of the compressed gas rises, which may also pose a risk of failure in the compressor body.

The object of the present invention is to provide a technology capable of reducing pressure loss caused by cooling of the compressed gas.

Solutions to Problems

To solve the above problem, one representative gas compressor of the present invention comprises: a motor; a compressor body driven by the motor; a waste heat recovery heat exchanger that recovers waste heat from compressed gas compressed by the compressor body; and a cooling heat exchanger that cools the compressed gas after waste heat has been recovered by the waste heat recovery heat exchanger. The gas compressor further includes: a first pipe for transferring the compressed gas from the waste heat recovery heat exchanger to the cooling heat exchanger; a second pipe for transferring the compressed gas from the cooling heat exchanger to the outside of the gas compressor; a bypass path connected to the first pipe and the second pipe at a first connection portion and a second connection portion, respectively, and configured to bypass the cooling heat exchanger; a bypass valve provided in the bypass path; a cooler bypass valve provided in the first pipe between the first connection portion and the cooling heat exchanger; an ammeter for detecting the current value of the motor; a temperature sensor for detecting the temperature of the compressed gas after waste heat has been recovered by the waste heat recovery heat exchanger; an ambient temperature sensor for detecting the ambient temperature around the gas compressor; and a control device for opening and closing the bypass valve and the cooler bypass valve based on the current value detected by the ammeter, the temperature detected by the temperature sensor, and the temperature detected by the ambient temperature sensor.

Effects of the Invention

According to the present invention, it is possible to reduce pressure loss caused by cooling of the compressed gas.

Other problems, configurations, and effects not mentioned above will become apparent from the following description of embodiments.

MODE FOR CARRYING OUT THE INVENTION

Hereinafter, embodiments will be described with reference to the drawings. In the following embodiments, a two-stage gas compressor is described as an example; however, the present invention is not limited thereto, and the gas compressor may be a single-stage gas compressor or a multi-stage gas compressor.

Embodiment 1

An embodiment of the present invention will be described with reference to the drawings.

Figure 1:
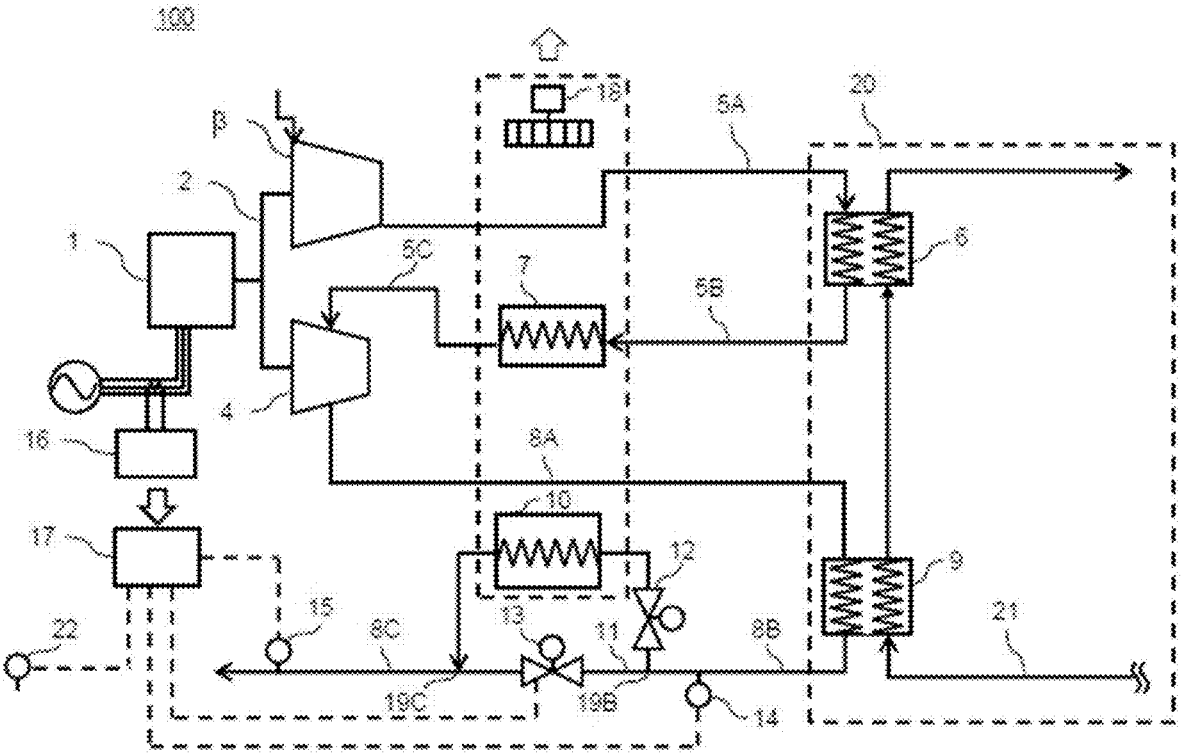
FIG. 1 is a schematic diagram illustrating an example of the configuration of the gas compressor according to Embodiment 1.

FIG. 1 is a schematic diagram illustrating an example of the configuration of the gas compressor according to Embodiment 1.

The gas compressor 100 includes: a motor 1; a power transmission mechanism 2 that transmits the rotational power of the motor 1; a low-pressure stage compressor body 3 and a high-pressure stage compressor body 4 that are driven by the motor 1 and compress air (gas); a low-pressure stage waste heat recovery heat exchanger 6 that recovers heat from the compressed gas compressed by the low-pressure stage compressor body 3; an intercooler 7 that cools the compressed gas; a low-pressure stage discharge pipe 5A that delivers the compressed gas from the low-pressure stage compressor body 3 to the low-pressure stage waste heat recovery heat exchanger 6; a low-pressure stage discharge pipe 5B that delivers the compressed gas from the low-pressure stage waste heat recovery heat exchanger 6 to the intercooler 7; and a low-pressure stage discharge pipe 5C that delivers the compressed gas from the intercooler 7 to the high-pressure stage compressor body 4.

The gas compressor 100 further includes: a high-pressure stage waste heat recovery heat exchanger 9 that recovers heat from the compressed gas compressed by the high-pressure stage compressor body 4; an aftercooler 10 that cools the compressed gas; a high-pressure stage discharge pipe 8A that delivers the compressed gas from the high-pressure stage compressor body 4 to the high-pressure stage waste heat recovery heat exchanger 9; a high-pressure stage discharge pipe 8B that delivers the compressed gas from the high-pressure stage waste heat recovery heat exchanger 9 to the aftercooler 10; a high-pressure stage discharge pipe 8C that delivers the compressed gas from the aftercooler 10 to the outside of the gas compressor 100; and a bypass path 11 that bypasses the aftercooler 10 and is connected to the high-pressure stage discharge pipes 8B and 8C via connection portions 19B and 19C, respectively.

Furthermore, the gas compressor 100 includes: a cooler bypass valve 12 provided in the high-pressure stage discharge pipe 8B between the connection portion 19B and the aftercooler 10; and a bypass valve 13 provided in the bypass path 11.

Furthermore, the gas compressor 100 includes: a temperature sensor 14 that detects the temperature of the compressed gas inside the high-pressure stage discharge pipe 8B; a pressure sensor 15 that detects the pressure of the compressed gas inside the high-pressure stage discharge pipe 8C; an ammeter 16 that detects the current value of the motor 1; a temperature sensor 22 that detects the ambient temperature around the gas compressor 100; and a control device 17 that controls the gas compressor 100.

The low-pressure stage waste heat recovery heat exchanger 6 and the high-pressure stage waste heat recovery heat exchanger 9 are part of a waste heat recovery unit 20. The low-pressure stage waste heat recovery heat exchanger 6 is provided upstream of the intercooler 7, and the high-pressure stage waste heat recovery heat exchanger 9 is provided upstream of the aftercooler 10.

The waste heat recovery unit 20 includes a water supply passage 21 through which water flows. Water in the water supply passage 21 is circulated by an unillustrated water supply pump provided upstream of the passage, passes through the high-pressure stage waste heat recovery heat exchanger 9 and then through the low-pressure stage waste heat recovery heat exchanger 6, and flows to an unillustrated water supply tank provided downstream of the water supply passage 21. By exchanging heat between the compressed gas flowing through the low-pressure stage waste heat recovery heat exchanger 6 and the high-pressure stage waste heat recovery heat exchanger 9, and the water flowing through the water supply passage 21, compression heat is recovered from the compressed gas and used to heat the water.

The cooler bypass valve 12 and the bypass valve 13 are opened and closed under the control of the control device 17 to allow or block the flow of the compressed gas.

The temperature sensor 14 is installed immediately downstream of the high-pressure stage waste heat recovery heat exchanger 9. The difference between the temperature detected downstream of the high-pressure stage waste heat recovery heat exchanger 9 and the ambient temperature around the gas compressor 100 detected by the temperature sensor 22 indicates the cooling performance of the high-pressure stage waste heat recovery heat exchanger 9.

The pressure of the compressed gas inside the high-pressure stage discharge pipe 8C, as detected by the pressure sensor 15, varies depending on the usage conditions of the compressed gas. When the gas compressor 100 is of the load/unload type, the control device 17 switches between load and unload modes based on the pressure detected by the pressure sensor 15. Even when the gas compressor 100 is of the inverter type, the control device 17 switches the operating state based on the pressure detected by the pressure sensor 15.

The ammeter 16 is connected to the wiring of the motor 1 and detects the current value flowing through the motor 1.

The low-pressure stage compressor body 3 includes, for example, a pair of male and female screw rotors that mesh with each other, a plurality of bearings that rotatably support the screw rotors, and a casing that houses them. A plurality of working chambers are formed in the rotor grooves of the screw rotors. Each working chamber moves in the axial direction of the rotors as the rotors rotate, and sequentially undergoes an intake process for drawing in air, a compression process for compressing the air, and a discharge process for discharging the compressed gas. The high-pressure stage compressor body 4 has substantially the same configuration as the low-pressure stage compressor body 3.

The intercooler 7 and the aftercooler 10 are arranged within a duct that houses a cooling fan 18, and are of an air-cooled type that cools the compressed gas using cooling air generated by the cooling fan 18. Note that a cooler for cooling fluids other than the compressed gas, such as lubricating oil, may also be installed within the duct. Additionally, the intercooler and the aftercooler may be of a water-cooled type that performs heat exchange between cooling water and the compressed gas.

Next, the flow of gas in the gas compressor 100 will be described.

The compressed gas compressed by the low-pressure stage compressor body 3 passes through the low-pressure stage discharge pipe 5A, has its heat recovered by the low-pressure stage waste heat recovery heat exchanger 6, then passes through the low-pressure stage discharge pipe 5B, and is further cooled by the intercooler 7. The cooled compressed gas is further compressed by the high-pressure stage compressor body 4, passes through the high-pressure stage discharge pipe 8A, and has its heat recovered by the high-pressure stage waste heat recovery heat exchanger 9.

When further cooling is to be performed by the aftercooler 10, the control device 17 outputs a signal to open the cooler bypass valve 12 and close the bypass valve 13. As a result, the compressed gas passes through the high-pressure stage discharge pipe 8B, is further cooled by the aftercooler 10, and is then delivered to the outside of the gas compressor 100 via the high-pressure stage discharge pipe 8C.

When the aftercooler 10 is to be bypassed, the control device 17 outputs a signal to close the cooler bypass valve 12 and open the bypass valve 13. As a result, the compressed gas flows through the bypass path 11 connected to the high-pressure stage discharge pipe 8B, bypasses the aftercooler 10, and is delivered to the outside of the gas compressor 100 via the high-pressure stage discharge pipe 8C.

Figure 2:
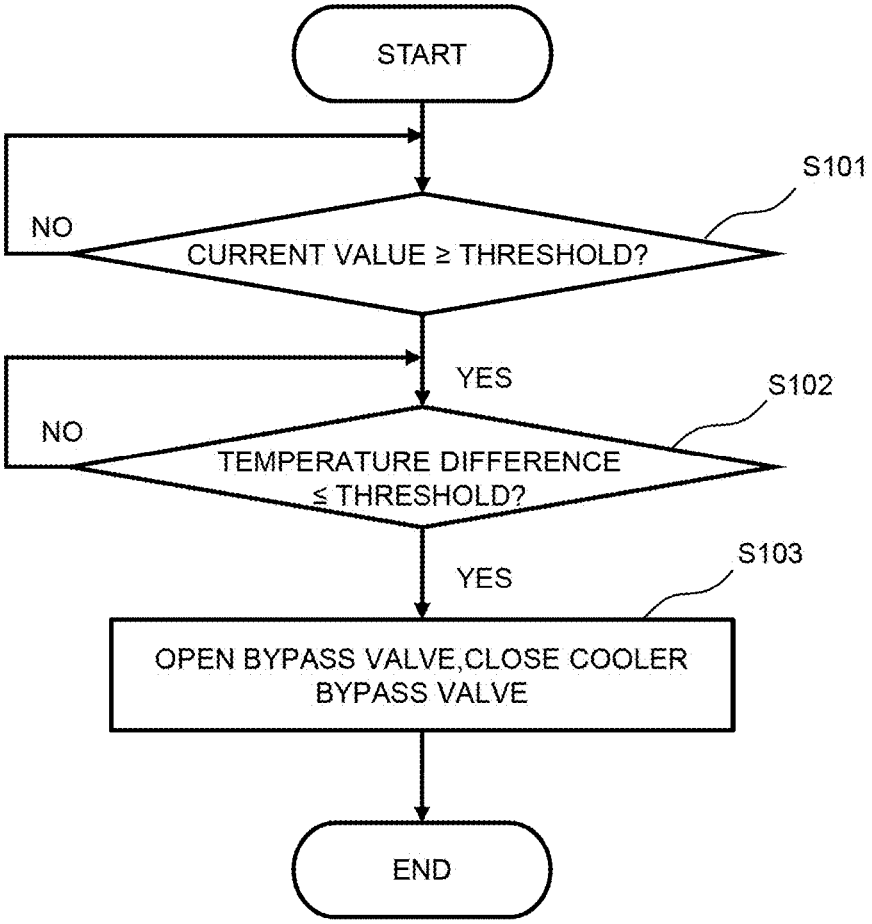
FIG. 2 is a flowchart illustrating an example of a path switching process executed by the control device.

FIG. 2 is a flowchart illustrating an example of a path switching process executed by the control device 17.

In step S101, it is determined whether the current value of the motor 1 detected by the ammeter 16 is equal to or greater than a predetermined threshold. This allows determination of whether the gas compressor 100 is operating at its rated current. The threshold is preset based on the rated current of the gas compressor 100.

Here, if the gas compressor 100 is operating at a current value exceeding the rated current, it is considered that the power of the gas compressor 100 has increased under the control of the control device 17 due to a large pressure loss caused by the cooling of the compressed gas.

If, in step S101, the current value of the motor 1 detected by the ammeter 16 is equal to or greater than the predetermined threshold, the gas compressor 100 is operating at a current value exceeding the rated current, and the process proceeds to step S102. On the other hand, if the current value of the motor 1 detected by the ammeter 16 is less than the predetermined threshold in step S101, the gas compressor 100 is operating at the rated current, and the process returns to step S101.

In step S102, it is determined whether the difference between the temperature of the compressed gas inside the high-pressure stage discharge pipe 8B, detected by the temperature sensor 14, and the ambient temperature around the gas compressor 100, detected by the temperature sensor 22, is equal to or less than a predetermined threshold. This determination is used to assess whether the compressed gas is sufficiently cooled by the high-pressure stage waste heat recovery heat exchanger 9. The threshold is preset according to the intended use of the compressed gas supplied from the gas compressor 100.

If, in step S102, the difference between the temperature of the compressed gas inside the high-pressure stage discharge pipe 8B detected by the temperature sensor 14 and the ambient temperature around the gas compressor 100 detected by the temperature sensor 22 is equal to or less than the predetermined threshold, the compressed gas is determined to be sufficiently cooled by the high-pressure stage waste heat recovery heat exchanger 9, and the process proceeds to step S103. On the other hand, if the difference between the temperature of the compressed gas inside the high-pressure stage discharge pipe 8B detected by the temperature sensor 14 and the ambient temperature around the gas compressor 100 detected by the temperature sensor 22 exceeds the predetermined threshold in step S102, the compressed gas is determined not to be sufficiently cooled by the high-pressure stage waste heat recovery heat exchanger 9, and the process returns to step S102.

In step S103, since the gas compressor 100 is operating at a current value exceeding the rated current and the compressed gas is sufficiently cooled by the high-pressure stage waste heat recovery heat exchanger 9, the control device 17 outputs a signal to open the bypass valve 13 and close the cooler bypass valve 12 in order to reduce pressure loss caused by cooling of the compressed gas. As a result, the flow path of the compressed gas is switched to the bypass path 11 that does not pass through the aftercooler 10, and the process ends.

As described above, according to Embodiment 1, when the current value of the motor 1 detected by the ammeter 16 is equal to or greater than a predetermined threshold, and when the difference between the temperature of the compressed gas inside the high-pressure stage discharge pipe 8B detected by the temperature sensor 14 and the ambient temperature around the gas compressor 100 detected by the temperature sensor 22 is equal to or less than a predetermined threshold, the control device 17 outputs a signal to open the bypass valve 13 and close the cooler bypass valve 12, thereby switching the flow path of the compressed gas to the bypass path 11 that does not pass through the aftercooler 10. As a result, pressure loss caused by cooling of the compressed gas can be reduced.

Embodiment 2

In the gas compressor of Embodiment 1, the cooler bypass valve 12 is provided on the upstream side of the aftercooler 10. In Embodiment 2, an example is described in which the cooler bypass valve 12 is provided on the downstream side of the aftercooler 10.

Figure 3:
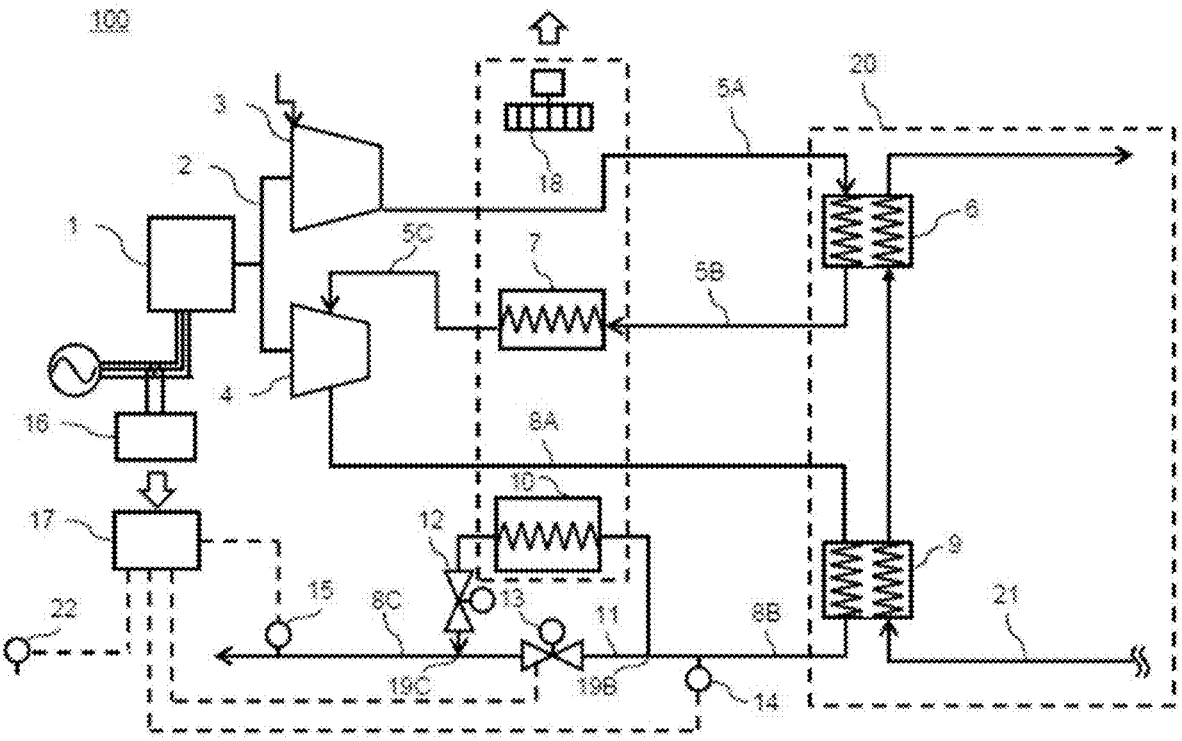
FIG. 3 is a schematic diagram illustrating an example of the configuration of the gas compressor according to Embodiment 2.

FIG. 3 is a schematic diagram illustrating an example of the configuration of the gas compressor according to Embodiment 2. In FIG. 3, components that are the same as those in FIG. 1 are denoted by the same reference numerals, and their descriptions are omitted.

In FIG. 3, the cooler bypass valve 12 is provided in the high-pressure stage discharge pipe 8C between the aftercooler 10 and the connection portion 19C. As a result, even when the cooler bypass valve 12 is closed, the compressed gas is cooled by the aftercooler 10.

In the gas compressor 100 shown in FIG. 3, the same path switching process as in FIG. 2 is executed.

According to Embodiment 2, as in Embodiment 1, when the current value of the motor 1 detected by the ammeter 16 is equal to or greater than a predetermined threshold, and when the difference between the temperature of the compressed gas inside the high-pressure stage discharge pipe 8B detected by the temperature sensor 14 and the ambient temperature around the gas compressor 100 detected by the temperature sensor 22 is equal to or less than a predetermined threshold, the control device 17 outputs a signal to open the bypass valve 13 and close the cooler bypass valve 12, thereby switching the flow path of the compressed gas to the bypass path 11 that does not pass through the aftercooler 10. As a result, pressure loss caused by cooling of the compressed gas can be reduced.

In addition, according to Embodiment 2, since the compressed gas is cooled by the aftercooler 10 even when the cooler bypass valve 12 is closed, it is not necessary to increase the heat resistance temperature of the cooler bypass valve 12.

It should be noted that the present invention is not limited to the embodiments described above, and various modifications are included. For example, the above-described embodiments are provided in detail for facilitating understanding of the present invention, and are not necessarily limited to those including all the configurations described. Furthermore, it is possible to replace part of the configuration of one embodiment with that of another embodiment, and it is also possible to add the configuration of another embodiment to the configuration of a certain embodiment.

In addition, part of the configuration of each embodiment may be added to, deleted from, or replaced with another configuration.

REFERENCE SIGNS LIST

1 Motor
4 High-pressure stage compressor body
9 High-pressure stage waste heat recovery heat exchanger
11 Bypass path
12 Cooler bypass valve
13 Bypass valve
14 Temperature sensor
16 Ammeter
17 Control device
22 Temperature sensor

The invention claimed is:

1. A gas compressor comprising:
a motor;
a compressor body driven by the motor;
a waste heat recovery heat exchanger that recovers waste heat from compressed gas compressed by the compressor body;
a cooling heat exchanger that cools the compressed gas after waste heat has been recovered by the waste heat recovery heat exchanger;
a first pipe that delivers the compressed gas from the waste heat recovery heat exchanger to the cooling heat exchanger;
a second pipe that delivers the compressed gas from the cooling heat exchanger to outside of the gas compressor;
a bypass path that is connected to the first pipe and the second pipe via a first connection portion and a second connection portion respectively and bypasses the cooling heat exchanger;
a bypass valve provided in the bypass path;
a cooler bypass valve provided in the first pipe between the first connection portion and the cooling heat exchanger;
an ammeter that detects a current value of the motor;
a temperature sensor that detects a temperature of the compressed gas after waste heat has been recovered by the waste heat recovery heat exchanger;
an ambient temperature sensor that detects an ambient temperature around the gas compressor; and
a control device that opens and closes the bypass valve and the cooler bypass valve based on the current value detected by the ammeter, the temperature detected by the temperature sensor, and the ambient temperature detected by the ambient temperature sensor.

2. The gas compressor according to claim 1,
wherein the control device,
when the current value detected by the ammeter is equal to or greater than a predetermined threshold and a difference between the temperature detected by the temperature sensor and the ambient temperature detected by the ambient temperature sensor is equal to or less than a predetermined threshold, opens the bypass valve and closes the cooler bypass valve.

3. A gas compressor comprising:
a motor;
a compressor body driven by the motor;
a waste heat recovery heat exchanger that recovers waste heat from compressed gas compressed by the compressor body;
a cooling heat exchanger that cools the compressed gas after waste heat has been recovered by the waste heat recovery heat exchanger;
a first pipe that delivers the compressed gas from the waste heat recovery heat exchanger to the cooling heat exchanger;
a second pipe that delivers the compressed gas from the cooling heat exchanger to outside of the gas compressor;
a bypass path that is connected to the first pipe and the second pipe and bypasses the cooling heat exchanger;
a bypass valve provided in the bypass path;
a cooler bypass valve provided in the second pipe between the cooling heat exchanger and a second connection portion;
an ammeter that detects a current value of the motor;
a temperature sensor that detects a temperature of the compressed gas after waste heat has been recovered by the waste heat recovery heat exchanger;
an ambient temperature sensor that detects an ambient temperature around the gas compressor; and
a control device that opens and closes the bypass valve and the cooler bypass valve based on the current value detected by the ammeter, the temperature detected by the temperature sensor, and the ambient temperature detected by the ambient temperature sensor.

4. The gas compressor according to claim 3,
wherein the control device,
when the current value detected by the ammeter is equal to or greater than a predetermined threshold and a difference between the temperature detected by the temperature sensor and the ambient temperature detected by the ambient temperature sensor is equal to or less than a predetermined threshold, opens the bypass valve and closes the cooler bypass valve.

* * * * *